US005683330A

United States Patent [19]

Kobayashi

[11] Patent Number: 5,683,330

[45] Date of Patent: Nov. 4, 1997

[54] SPRINT TRAINING MACHINE

[75] Inventor: Kando Kobayashi, Machida, Japan

[73] Assignee: The University of Tokyo, Tokyo, Japan

[21] Appl. No.: 731,007

[22] Filed: Oct. 9, 1996

[30] Foreign Application Priority Data

Dec. 11, 1995 [JP] Japan ..... 7-321435

[51] Int. Cl.[6] ..... A63B 26/00

[52] U.S. Cl. ..... 482/51; 482/57; 482/70; 601/36

[58] Field of Search ..... 482/51, 54, 57, 482/63, 70, 71; 601/34, 35, 36

[56] References Cited

U.S. PATENT DOCUMENTS

| | | | |
|---|---|---|---|
| 5,246,412 | 9/1993 | Chen | 482/70 |
| 5,336,141 | 8/1994 | Vittone | 482/51 |
| 5,391,130 | 2/1995 | Green et al. | 482/51 |
| 5,403,255 | 4/1995 | Johnston | 482/51 |
| 5,419,747 | 5/1995 | Piaget et al. . | |
| 5,496,235 | 3/1996 | Stevens | 482/51 |
| 5,518,473 | 5/1996 | Miller | 482/51 |
| 5,529,555 | 6/1996 | Rodgers, Jr. | 482/51 |

*Primary Examiner*—Lynne A. Reichard

*Attorney, Agent, or Firm*—Sughrue,Mion,Zinn,Macpeak & Seas, PLLC

[57] ABSTRACT

A sprint training machine including a pair of backward and forward movable pedestals respectively provided with a pedal, an arm and a crank and operable independently from each other; a power engine for shifting the movable pedestals by a predetermined distance; a power transmitting portion; and a load controlling means for controlling a resistive load during a pedaling exercise such that a resistive load is applied to the operator when the pedal is located lower than a horizontal position of the pedal arm while no resistive load is applied to the operator when the pedal is located higher than the horizontal position of the pedal arm.

1 Claim, 7 Drawing Sheets

SPRINT TRAINING MACHINE

BACKGROUND OF THE INVENTION

1. Field of the Invention

A sprint training machine according to the present invention provides a training apparatus for improving kinetic ability in running and walking, and an operator doing running exercise or walking exercise with use of the sprint training machine according to the present invention can enjoy the following advantages:

1) An ideal running form can be learned through a coordination of muscular and nervous systems by moving leg portions in accordance with a mechanically fixed locus of movement; and
2) Training effect of muscles including leg muscles and trunk muscles which is useful for improving running and walking ability can be obtained by voluntarily using certain muscles against a resistive load applied thereto in a particular portion of the locus of movement. The present invention may be applied to 1) a sprint training machine, 2) an axle-shifting bicycle type ergometer, 3) a pedal-type treadmill apparatus and the like.

2. Description of the Related Art

As prior art machines, mention may be made of a treadmill apparatus, bicycle-type ergometer, stepping-type ergometer, cross-country sky-type training machine and the like. However, they all involve some of the problems described below and thus, muscle training effect of those apparatuses have been poor.

1. Treadmill apparatus

A treadmill apparatus (a caterpillar-type running plate) is a loading-type exercise machine in which a rolling speed of a caterpillar belt as a walking (running) surface as well as an inclination angle of the caterpillar belt can be adjusted. Running exercise or walking exercise on the treadmill apparatus is often done for the purpose of improving general stamina. However, correction of running form cannot be passively materialized by such an exercise. In addition, a training machine of this type is not effective for positive muscle power training.

2. Bicycle-type ergometer

A bicycle-type ergometer is a loading-type exercise machine utilizing pedaling of a fixed bicycle. Such bicycle-type ergometers are employed for the purpose of strengthening leg muscles power or improving general stamina. However, since the training is conducted through pedaling of fixed turning radius, the exercise ranges of muscles are limited when compared with those in the case of running.

3. Stepping-type ergometer (e.g. STRIDING-TYPE EXERCISE APPARATUS, U.S. Pat. No. 5,419,747)

During the exercise with use of a stepping-type ergometer, a user stands on right and left steps and alternately treads the steps just like climbing stairs. Accordingly, leg portions of the operator repeat up-and-down motions along a part of an arc within a certain range. Since this is a treading-in-place exercise tracing a part of an arc whose center is a rotation axis, the locus of this motion is different from the locus of movement of leg in the actual running or walking motion. Therefore, it is difficult to generally and particularly train the muscles and nervous system used in running or walking by the exercise utilizing these stepping-type ergometers.

4. Cross-country sky-type training machine

During the exercise using a cross-country sky-type training machine, an operator widely slides their legs back and forth in reciprocating motion and they also move their arms like a stickwork. Since legs of the operator horizontally move back and forth on the floor surface, there can be attained a muscle power training effect related to a posture having a constant contact with the ground. However, it is not possible to simulate such movements of running motions, in which a leg is backwardly curled up after the kicking and then thrown forward, by a training machine of this type.

As described above, conventional moving loading-type exercise machines related to moving exercises include a treadmill apparatus, bicycle-type ergometer, stepping-type ergometer, cross-country sky-type training machine and the like. However, any one of these apparatuses cannot be fulfilled the requirements of the present invention which will be stated below as the objects of the invention.

As the studying results of sports science, in which motion analyses of top sprinters of the world (such as Carl Lewis) are conducted and a relation between the strength of leg muscles and running ability is studied, it has been confirmed that it is necessary for marking a good record in a short-distance race to strengthen the extensor muscle group (hamstring muscles) and flexor muscle group (quadriceps muscle of thigh) at the hip joint in order to quickly move thighs around the hip joint as the pivot. Although it has been pointed out that the performance of extensor muscle group, mainly that of the hamstring muscles at the hip joint is particularly important, there has not been a conclusive method for strengthening the extensor muscle group at the hip joint. Conventional training of the extensor muscle group at the hip joint conducted by utilizing rubber tubes or conventional muscle power training machine such as a leg curl machine was not always effective or right to the point.

SUMMARY OF THE INVENTION

This invention relates to a development of a training machine having the following functions.

1) To effectively strengthen the extensor muscle group at the hip joint (especially the hamstring muscles) which is considered to be necessary for improving the sprint ability as well as the related muscles which are considered to be necessary for an ideal running motion through an exercising form which is similar to the actual running motion.
2) To make a user learn a leg movement pattern which creates such running motion that is considered to be ideal for running fast by having person repeatedly trace a certain locus of movement on the training machine.
3) To correct an imbalance between right and left sides of the form which occurs during a natural walking or running, thereby helping the prevention of injury and to provide an exercise stimulation which is effective for improvement of the health.

Accordingly, the first object of the present invention is to realize an exercise machine basing on the following thought: "It is ideal for improving the muscle related to the sprinting ability to be strengthened through such a training form that is similar to the actual running motion."

Further, starting from such thought that "Ideal movement of legs which is most efficient and helpful for running fast should be constituted by combining motions which are based on the circular motion like as the theory of circular wheel movement.", there has been considered that an ideal running form similar to the running motions of top sprinters can be produced by combining circular motions. Basing on such an idea, the second object of the present invention is to develop a training machine by which anyone can learn the ideal locus of running.

The third object of the present invention is to develop a training machine which can be used for correction of a running form, and additionally for improvement of health, since sports injuries during running may often be caused by an unnatural movement of legs or imbalance in the movements of right and left sides of the body.

Consequently, the present invention is to provide a sprint training machine comprising:

- a pair of right and left movable pedestals respectively provided with a pedal, an arm and a crank and operable independently from each other;
- a power engine for shifting the movable pedestals back and forth by a certain shifting distance which is adjustable within a 1 m at a certain reciprocating moving speed which is also adjustable;
- a power transmitting portion thereof;
- a load controlling means for controlling a resistive load during a pedaling exercise such that a resistive load is applied to an operator when the pedal is located lower than a horizontal position of the pedal arm while no resistive load is applied to the operator when the pedal is located higher than the horizontal position of the pedal arm; and
- a hand-rail for supporting the operator to balance themself during the pedaling exercise wherein a weight of the operator is supported by the right and left pedals;
- wherein a sprint training machine being constituted such that a resistive load is applied to the operator when the pedaling exercise is conducted at a position lower than the horizontal position of the pedal arm and that no resistive load is applied to the operator when the pedaling exercise is conducted at a position higher than the horizontal position of the pedal arm, while a rotation axis of the pedal arm is shifted back and forth by a certain distance by means of the power engine.

BRIEF DESCRIPTION OF THE DRAWING

The present invention will be explained in further detail with reference to the attached drawings.

DESCRIPTION OF REFERENCE NUMERALS

1, 1A and 1B is a movable pedestal, 2, 2A, 2B is a pedal, 3, 3A and 3B is an arm, 4, 4A and 4B is a crank, 5 is a power engine, 6 is a power transmitting portion, 7 is load controlling means, 8 is a hand rail, 9, 9A and 9B is a rotating axis of pedal, 10 is a toothed belt, 11, 11A and 11B is a rotating axis of cam, 12A, 12B, 13A and 13B is a sprocket, 14 is a cam mechanism, 15, 15A and 15B is a load transmitting rod, 16, 16A and 16B is a superball-rail system, 17, 17A and 17B is a system table, 18 is a driving apparatus, 19 is a chain, 21 is a handle, 24 is a fixed portion, 25, 26 is a sprocket, 27 is a electromagnetic brake, 28 is a supporting frame, 29 is a screw rod, 30 is a screwed portion.

DESCRIPTION OF THE PREFERRED EMBODIMENTS

The present invention will be hereinafter explained in further detail referring to a preferred embodiment.

Figure 1:
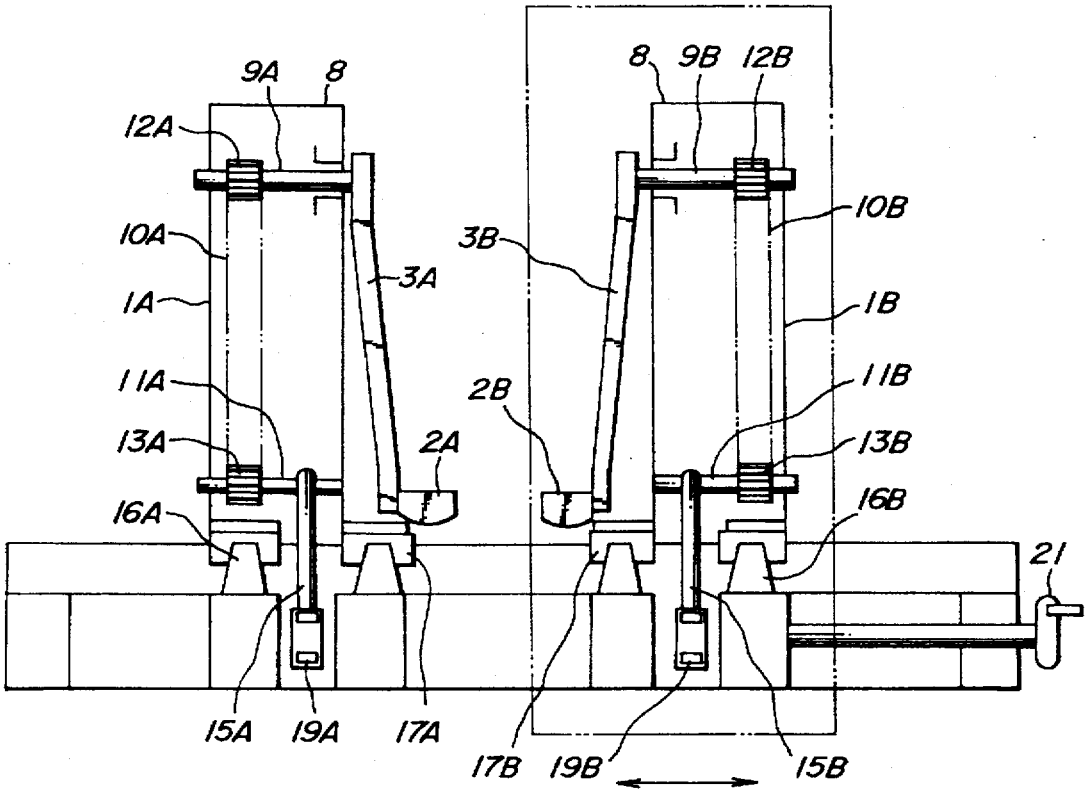
FIG. 1 is a front view illustrating one embodiment of the apparatus according to the present invention.
Figure 2:
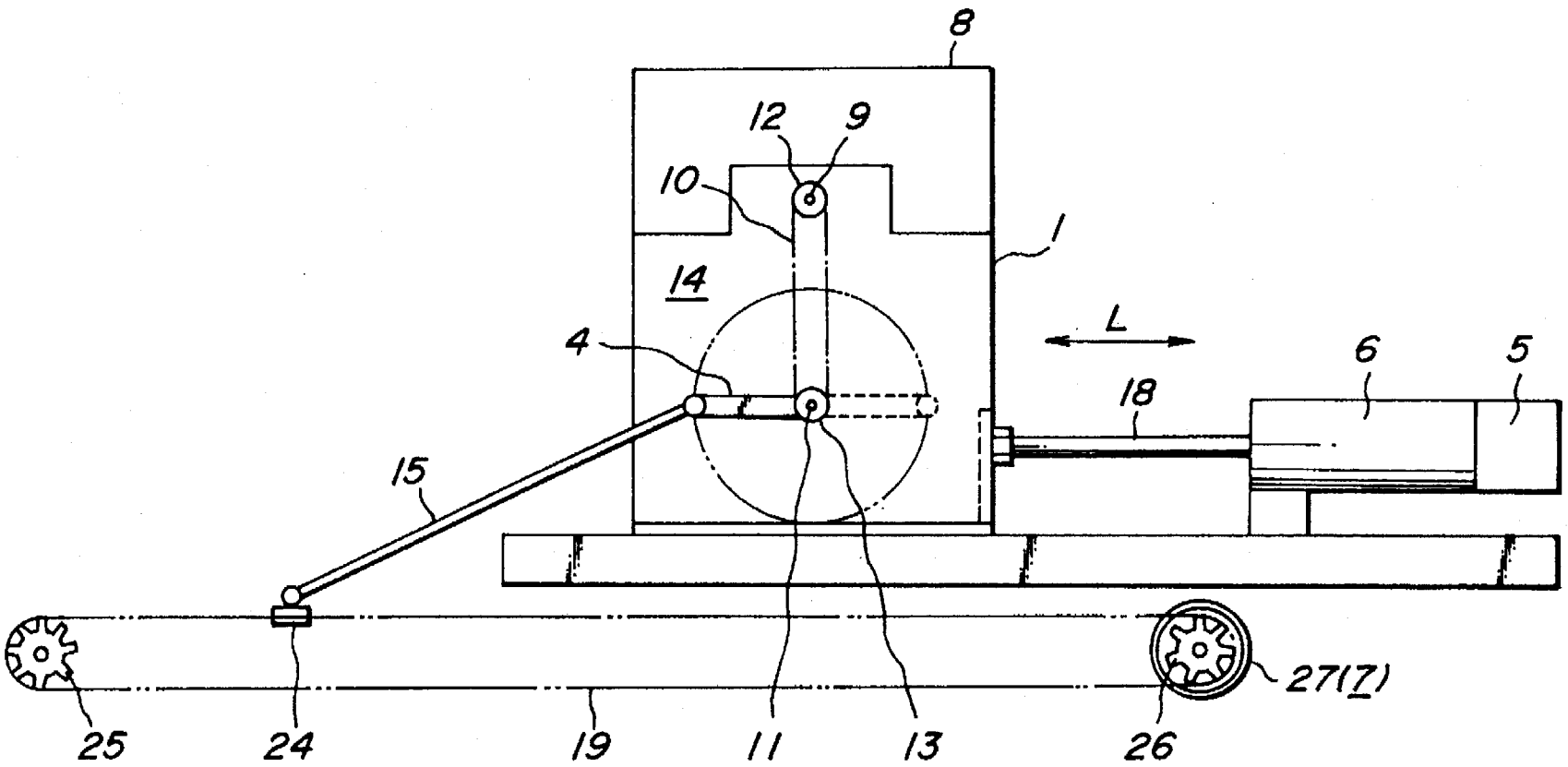
FIG. 2 is a side view illustrating one embodiment of the apparatus according to the present invention.

Referring to FIG. 1 and 2, there are respectively shown a front view and side view of a preferred embodiment of the apparatus according to the present invention. An apparatus according to the present invention is basically composed of a pair of right and left movable pedestals 1 for right and left legs, which pedestals being respectively provided with a pedal 2, an arm 3 and a crank 4 and operable independently from each other; a power engine 5; a power transmitting portion 6; a load controlling means 7; and a hand-rail 8 for supporting a body of an operator by hands.

FIGS. 1 and 2 are views respectively showing the constitution of the preferred embodiment of the invention. The pedal 2 is a member for supporting a sole portion of the operator, and the sole portion is fixed to the pedal by a belt or the like provided to the pedal 2. The arm 3 performs a function as a radius of rotation for rotating the pedal 2 on a rotation axis 9. A toothed belt 10 is engaged with sprockets 12 and 13 respectively mounted to the rotation axes 9 and 11 of pedal and cam by rotation of the pedal 2 and the arm 3 on the rotation axis 9, and with the shifting of a phase of the belt rotates the lower rotation axis 11 of cam. A cam mechanism 14 connects the above-mentioned rotation around the rotation axis to a load transmitting rod 15. A super ball rail system 16 is an operation system for shifting the movable pedestals 1A and 1B by a predetermined distance L in a back-and-forth direction (i.e. a vertical direction with respect to a sheet surface of FIG. 1). The movable pedestals 1 are moved on the super ball rail system 16A and 16B back and forth at a certain period by a driving apparatus 18 in a system table 17, and a moving speed of the pedestals is adjustable. An end portion of the load transmitting rod 15 which is on the opposite side of the cam mechanism 14 is connected by a fixed portion to a chain 19, and one end of this chain 19 is linked to an electromagnetic brake 27 in a sprocket 26. The electromagnetic brake 27 is one utilizing a solenoid or the like and a value of the load is changeable. Because of this electromagnetic brake 27, a load resistive to the advancement of the chain can be applied only when the chain is moving from the front to the rear (i.e. from the right to the left in FIG. 2).

Figure 3A:
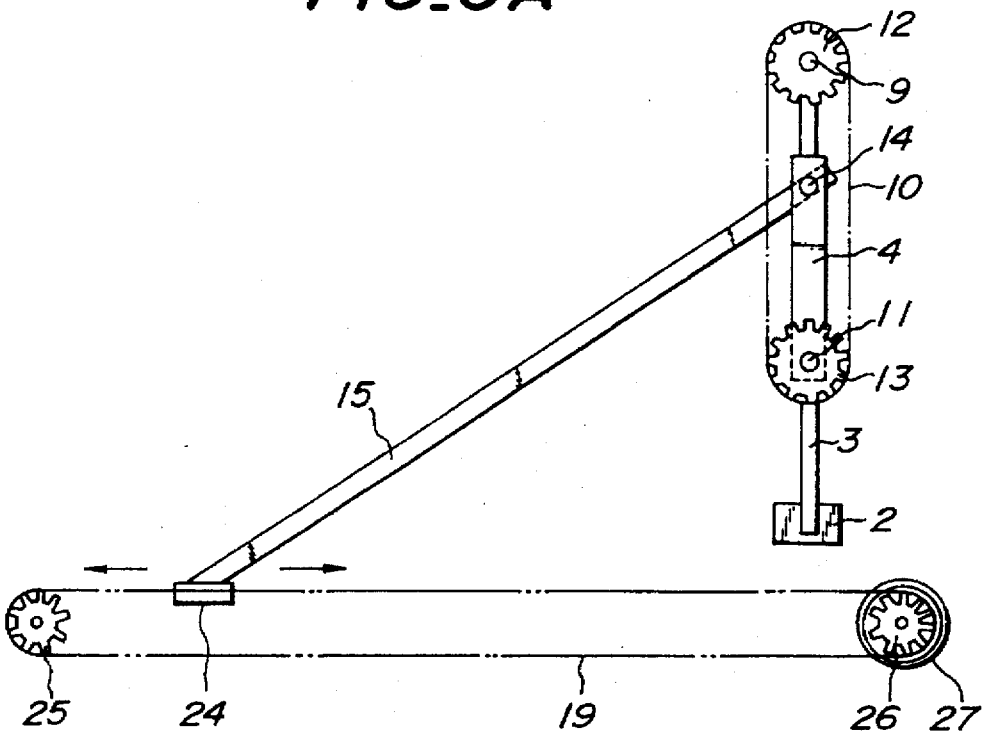
FIGS. 3A and 3B are view for explaining a cam mechanism for the apparatus according to the present invention.
Figure 3B:
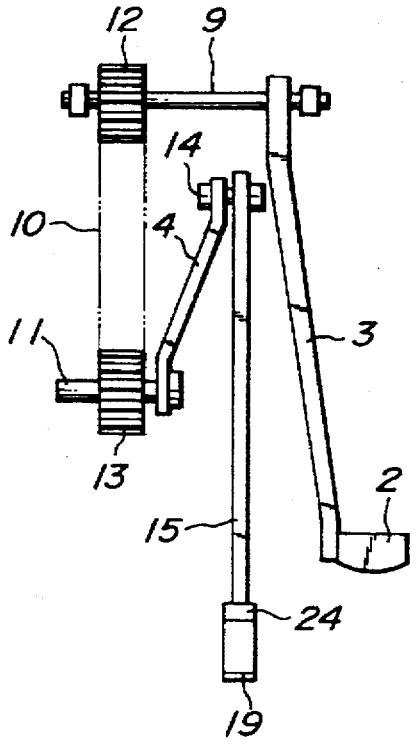

In FIG. 3, there is shown the above-mentioned cam mechanism 14. By the intervention of this cam mechanism, it becomes possible to apply a load with the combined exercise, in which the rotation exercise of the pedal 2 and the back and forward movement of the movable pedestal 1 are combined, within a certain range of the movements. Incidentally, these devices are composed of a pair of symmetrical members, and they can be operated alternately and independently. Furthermore, positions of the above-mentioned two pedestals can be laterally adjusted by manipulation of a handle 21 shown in FIG. 1, thereby adjusting a distance between the right and left pedals. In this manner, an appropriate setting of the training machine of the present invention can be done to accommodate the physical difference of operators.

Figure 4:
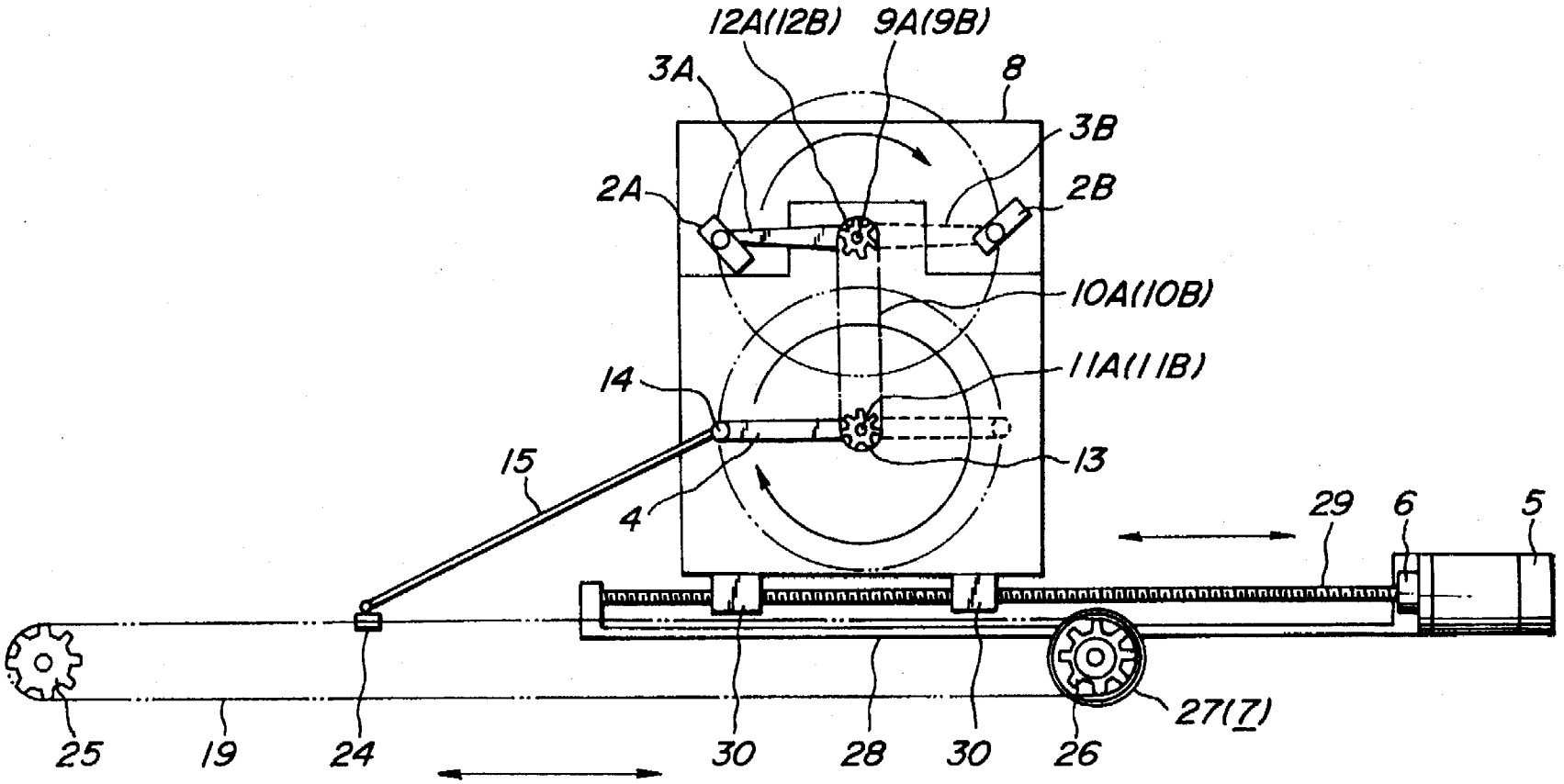
FIG. 4 is a side view depicting a loading mechanism for the apparatus according to the present invention in details.

Referring to FIG. 4, there is minutely illustrated a cam mechanism for transmitting motions, in which the right and left pedals 2A and 2B are shown by a solid line and dotted line, respectively. The pedal 2A and 2B are respectively fixed to the rotation axes 9A and 9B through the arms 3A and 3B. The rotation axes 9A and 9B are respectively provided with the sprockets 12A and 12B, and the toothed belt 10A and 10B are engaged with the sprockets 12A and 12B, respectively. The toothed belt 10A and 10B are also engaged with the sprockets 13A and 13B respectively mounted to the lower rotation axes 11A and 11B of the cam mechanism, thereby transmitting rotations of the pedal 2A, 2B and arm 3A, 3B on the upper rotation axes 9 to the lower rotation axes 11 of the cam mechanism. As a result, cranks 4 mounted to the rotation axes 11 are rotated in accordance with the operation of the pedals 2 which are mounted to the upper rotation axes 9. A load transmitting rod 15 is hinged to an end portion of the crank 4. The other end portion of the load transmitting rod 15 is fixed to the chain 19 at a fixed portion 24. The chain 19 is stretched around the sprockets 25 and 26 located on the both ends, and an electromagnetic brake 27 is mounted to the sprocket 26 as a load controlling means 7.

The power transmitting portion 6 of the movable pedestal 1 is constituted such that a screw rod 29 for shifting the rotation axis, which is supported by a supporting frame 28 of the movable pedestal 1, is engaged with engaging portions 30 on the lower side of the pedestal 1; and the pedestal 1 is shifted forward or backward by leftward rotation or rightward rotation of the screw rod 29. The screw rod 29 is rotated by using a servo-motor as the power engine 5 and the servo-motor is controlled to rotate clock-wise or anticlockwise direction so that the pedestal 1 is shifted forward or backward at a certain speed.

When an operator uses the sprint training machine of the present invention, the operator stands on the pedals 2A, 2B connected to the movable pedestals for right and left legs, and fixes the foot portions to the pedals 2A, 2B. By using the power engine, the movable pedestals 1 continuously repeat reciprocating motions in the back-and-forth direction by a predetermined distance L at a certain fixed speed. In this reciprocating motion, the pedestal for right leg and that for left leg alternately move in a completely opposite directions to each other.

This means that at this time the operator is conducting pedaling exercise of both legs in accordance with the movements of pedestals repeating the reciprocating motions. During the pedaling, the operator forcefully pedals backward from the front position at the timing when the movable pedestal 1 moves backward from the front position, and pulls the pedal forward from the rear position along the circular orbit of the pedal 2 at a timing when the movable pedestal 1 moves forward from the rear position (See FIGS. 5 and 6). This training machine is designed such that a resistive load is applied to a leg within the exercising range wherein the arm to which the pedal 2 is connected is located lower than the horizontal position and no resistive load is applied within the exercising range in which the arm is located higher than the horizontal position. This means that muscular strength is fully used within the range lower than the horizontal position because such exercise range corresponds to kicking motion of running, and that no load is applied to the leg within the range higher than the horizontal position as like the case of actual running because the motion within such range corresponds to a motion pulling the leg forward after the kicking in the actual running.

Figure 5:
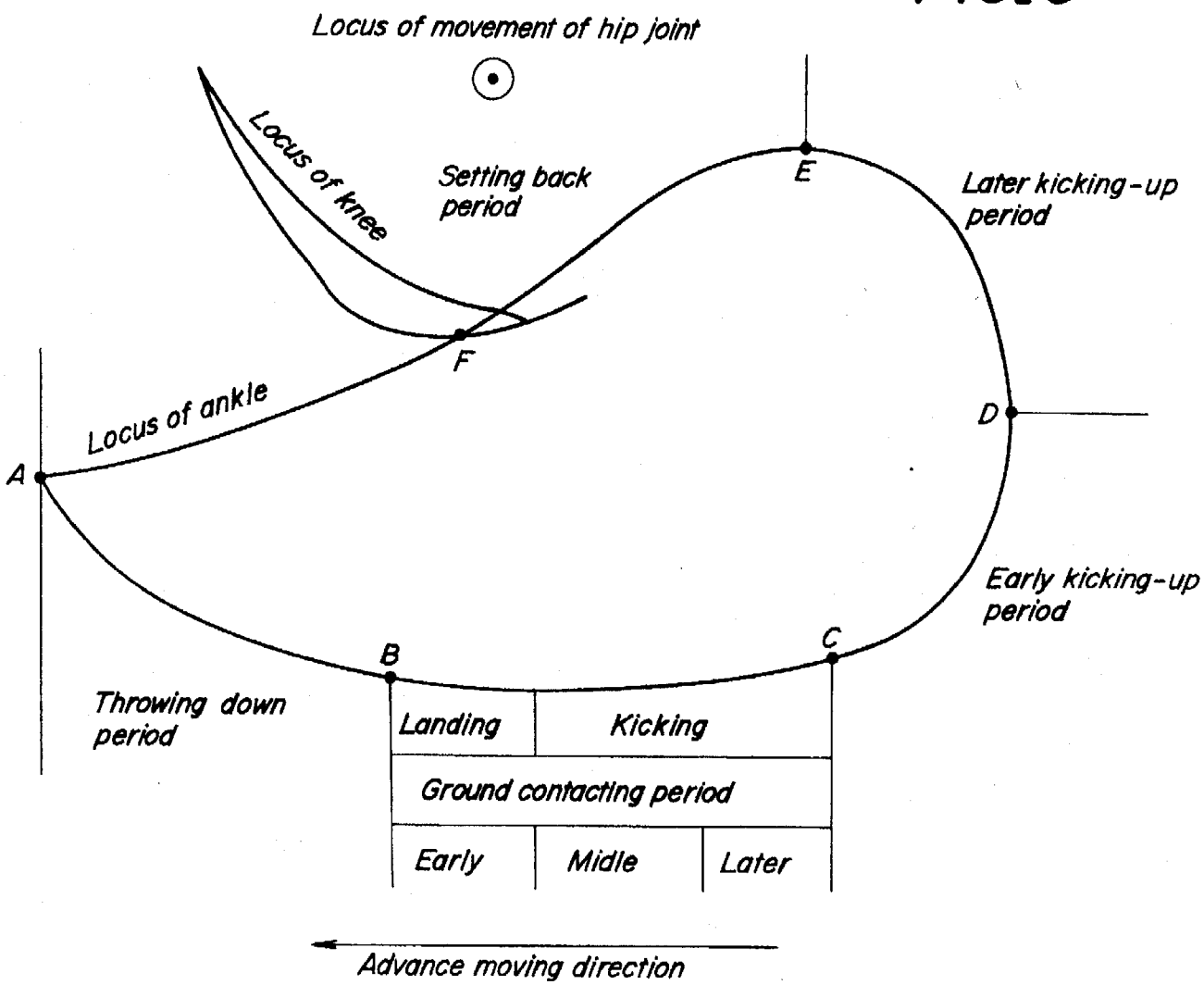
FIG. 5 is a view showing respective locus of movement of greater trochanter (hip-joint), knee and ankle during a fast running of the same sprinter who used one embodiment of the apparatus according to the present invention.
Figure 6:
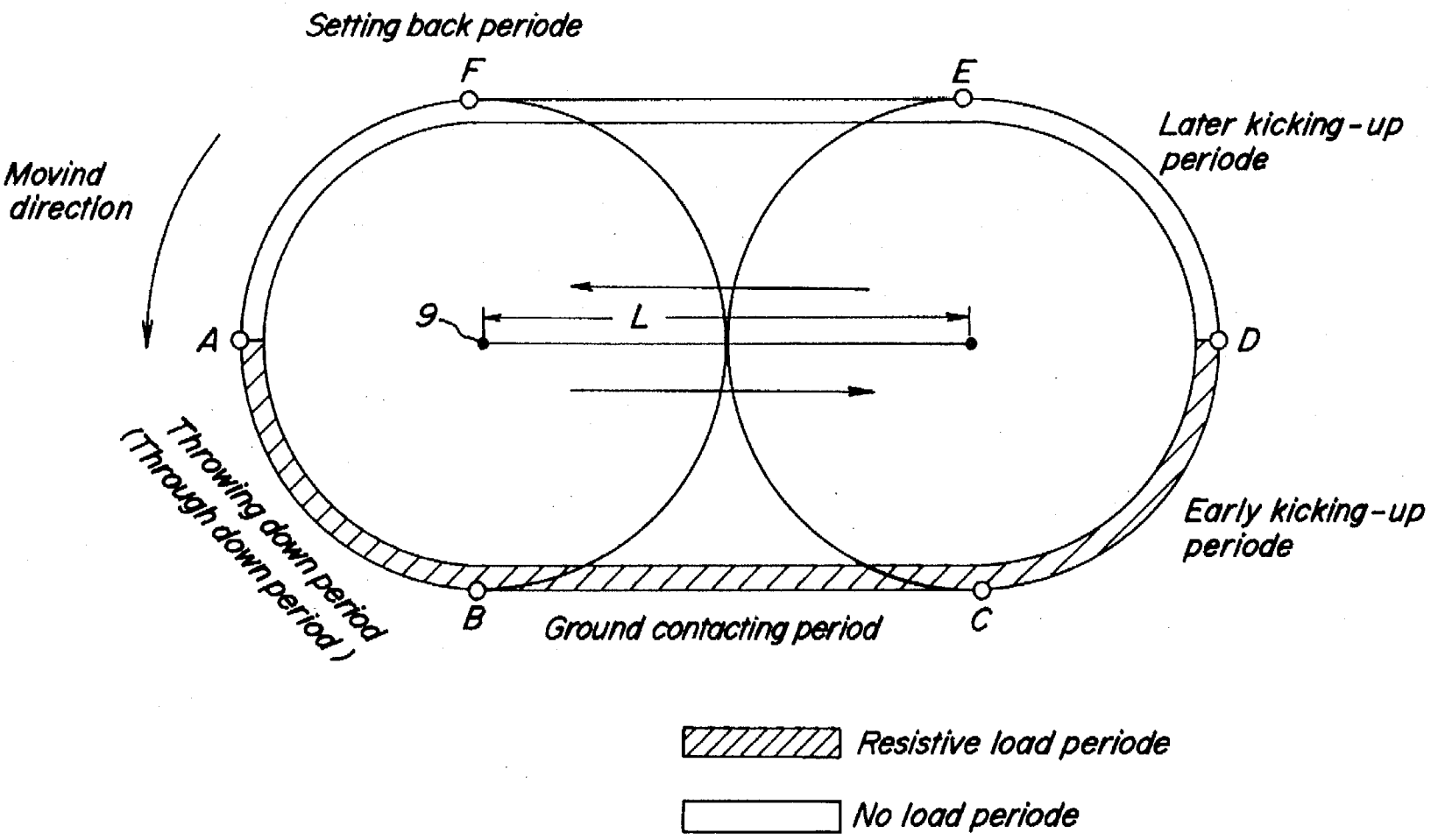
FIG. 6 is a view for explaining a locus of movement of one embodiment of the sprint training machine according to the present invention in contrast with the locus of movement of a leg portion during a running in which a hatched portion is a resistive loading period and a no hatched portion is no loading period.
Figure 7:
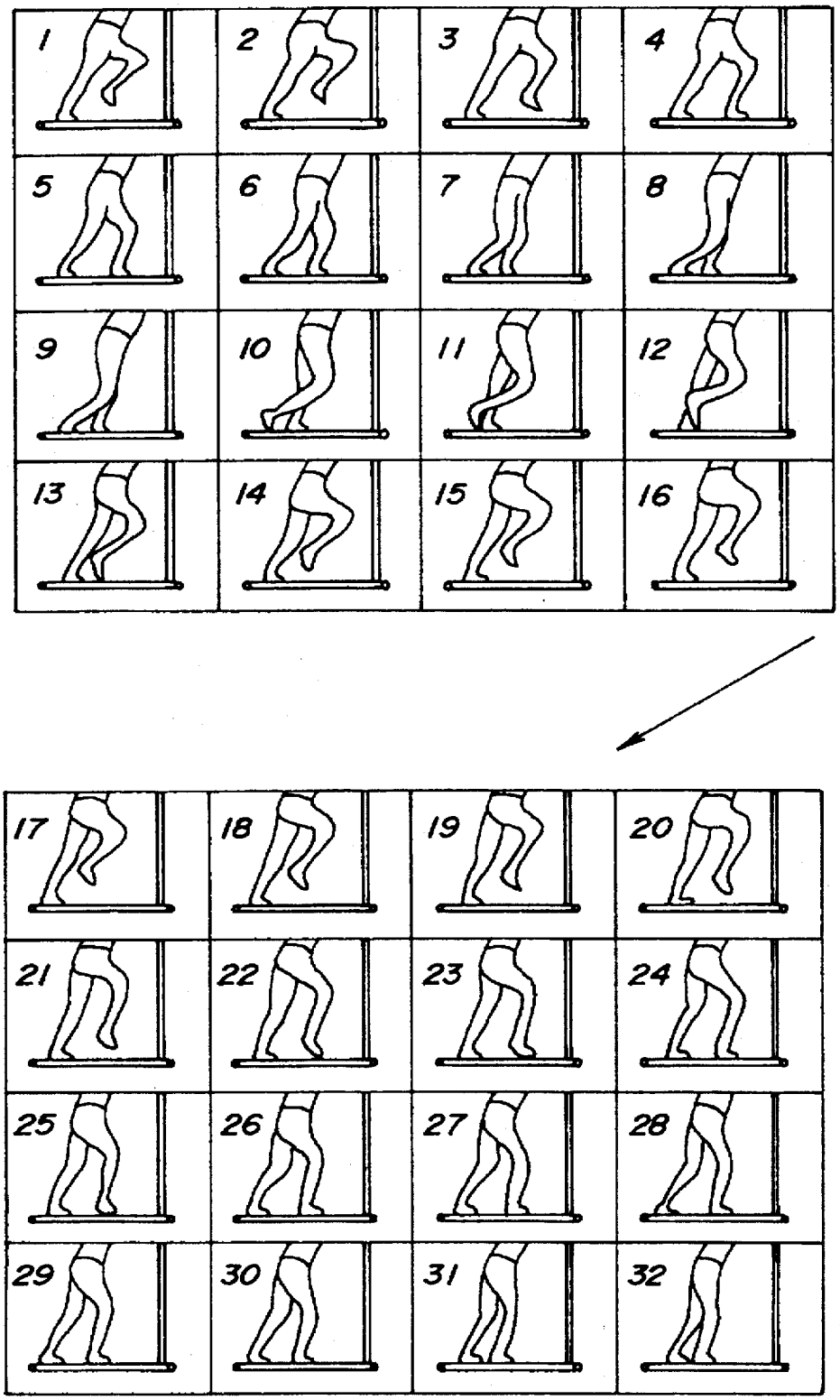
FIG. 7 is a view for illustrating a locus of movement of a leg portion of the operator who used one embodiment of the apparatus according to the present invention.

Referring to FIG. 5, there are shown respective locus of movement of haunch, knee and ankle during running (sprinting) of a top sprinter, and such locus of movement are respectively drawn as a side view while having a hip joint as the reference point. The section AB corresponds to a throwing down period of running; the section BC corresponds to a ground-contacting period; the section CD corresponds to an early part of a kicking-up period; the section DE corresponds to a latter part of the kicking-up period; and the section EA corresponds to a setting back period. In the ground-contacting period of an actual running, landing occurs during the early part of this period and kicking occurs during the middle and latter parts of this period. The constitution of a sprint training machine according to the present invention is based on such thought that a resistive load is only applied to an operator during the throwing down period AB, ground-contacting period BC and early part of a kicking-up period CD and no load is applied during the latter part of the kicking-up period DE and setting back period EA. In a usual pedaling of a bicycle-type ergometer, pedal driving power is mainly used in such exercise range that corresponds to the throwing down period AB and early part of the ground-contacting period BC of actual running. Now, the exercise with the use of the bicycle-type ergometer will be considered with respect to one leg. If the rotation axis of the arm can be horizontally moved backward without changing the waist position of the operator at the time when the pedal is located at the lowest position after the pedaling from the front position, the pedal can be continuously pushed in the rear of the body of operator. In other words, muscular power corresponding to that used in the kicking period BC of running can be used in this movement. Furthermore, in a case where the foot portion is fixed to the pedal, muscular power corresponding to that used in the early part of kicking-up period CD of running can be used in a curling-up motion of the pedal in the rear position. In the movement corresponding to the latter part of kicking-up period DE and setting back period EA of running, the rotation axis of the arm is horizontally moved forward. No load resistive to the pedal rotation is applied during this movement. This relation is shown in FIG. 6. Specifically, as understood from FIG. 6, the section AB corresponds to the throwing down period of running; the section BC corresponds to the ground-contacting period; the section CD corresponds to the early part of the kicking-up period; the section DE corresponds to the latter part of the kicking-up period; and section EFA corresponds to the setting back period. By the exercise using the sprint training machine of the present invention, the quadriceps muscle of thigh is mainly trained in the section ABC, and so is the extensor muscle group at hip joint in the section CD. The locus of movement of the foot portion in the actual motion of exercise using the sprint training machine of the present invention traces a rotating circumference of a circular motion whose rotation axis 9 is horizontally moved back and forth (axle-shifting type pedaling). At first sight, the locus of movement of the ankle in the setting back period of this case seems to be slightly different from that of the actual running motion. Although the position of the hip joint is fixed in this model shown in FIG. 6, in the actual motion of exercise using the sprint training machine of the present invention, the hip joint is slightly lifted up in a diagonal direction to the front in accordance with the movement of the foot portion during the setting back period. Accordingly, the operator has a posture in which the knee joint is raised to a high position at that time and thus, the actual locus of movement of the ankle should be revised to one relatively more similar to that of the actual running motion (See FIG. 7). Although the sole portion is tightly fixed to the pedal, the movement of the ankle on the ankle joint is free as in the case of pedaling of a usual bicycle. As a result, the operator can smoothly exercise a treading motion from the heel that corresponds to the landing motion in the actual running as well as a pushing motion with use of the foot and toes corresponding to the kicking motion in the actual running, in stead of the locus of movement of the ankle portion which actually traces the circumference of the pedal rotation.

The lifting of the hip joint in a diagonal direction to the front in the setting back period EFA is generated through a supple movement of pelvis. This lifting of the hip joint in combination with the raising of knee to a higher position is a basic element for building up an ideal form for sprinting. The sprint training machine according to the present invention is also very effective for leaning the usage of muscles during the sections ABCD, the relaxation in a load-free state during the sections DEFA, and the coordination of muscular and nervous systems. When muscles are used for driving the pedals, the body of the operator can be supported by grasping the hand-rail 8 on either side, which has an upward inclination of 30 degrees.

The shifting distance L and shifting speed of the rotation axis in sections BC and EF can be controlled by a computer. In the section EFA corresponding to the setting back period, the operator should adjust the timing of throwing down for the next cycle starting from the point A depending on the shifting speed in the section EF. Also, by changing the length of the arms, the sprint training machine according to the present invention can be accommodated to various operators of different size as well as to various training for running and walking motion which are adapted to respective characters of different sport events.

Through the exercise using the sprint training machine according to the present invention, there can be attained the following effects.

1) Effect of iteratively learning the ideal locus of movement in running motion

Although it is possible to imaginatively understand such theory that the foot portion should move along a circular orbit just like a wheel in a model movement for most efficient, ideal running motion, it has been impossible to actually experience or learn such a movement. However, the present invention has made it possible to learn the ideal model movement in which the foot portion moves along a circular orbit. All the athletes (sprinters and marathon runners) who did training with use of the sprint training machine according to the present invention has experienced remarkable correction of respective running forms immediately after the training and their records have also been improved.

2) Muscle strength training effect which directly leads to improvement of sprinting ability The present invention has made it possible to effectively train the extensor muscle group at the hip joint, which is considered to be directly connected to the improvement of the sprint ability, through an exercising form which is similar to the actual running motion. Since the exercise range in which the muscle strength is used against the resistive load is rather wide in the sprint training machine of the present invention, the operator can reflectively adjust the somatic sensation with respect to concentration of muscle power or timing for the use of muscles. In addition, since the operator exercises the muscles of the leg portion while grasping the hand-rails, muscles in the trunk portion and arm portions are also used during the training, thereby resulting in a training of muscles of whole-body.

3) Effect of correcting imbalance between right and left sides of running form

Since the movements of right and left pedals are completely symmetrical in the sprint training machine of the present invention, an imbalance in the locus of motion of the operator is revealed by the exercise with use of this machine. However, such imbalance of the running form can be corrected by moving the legs in accordance with the movements of the machine.

4) Effect of learning relaxation in running motion

Since no resistive load is applied within the exercising range in which the pedal arm is located higher than the horizontal position, the use of muscle power can be suppressed to the minimum in the latter part of the kicking-up period as well as in the setting back period. Therefore, the present invention has made it possible to effectively learn relaxation in the running motion, which had been considered difficult to be realized.

5) Effect of improving suppleness of body

The lifting of the hip joint in a diagonal direction to the front and the raising of knee to a higher position in the setting back period leads to improvement of suppleness of the body which is necessary for building up an ideal form for sprinting.

Although the invention has been described with reference to a specific preferred embodiment, it was given by way of examples only and thus, it should be noted that various changes and modifications may be made on it without departing from the scope of the present invention as defined by the appended claims.

What is claimed is:

1. A sprint training machine comprising:

a pair of forward and backward movable pedestals respectively provided with a pedal, an arm and a crank and operable independently from each other;

a power engine for shifting said movable pedestals backward and forward by a certain shifting distance which is adjustable within a one meter range at a certain reciprocating speed which is also adjustable;

a power transmitting portion;

a load controlling means for controlling a resistive load during a pedaling exercise such that a resistive load is applied when the pedal is located lower than a horizontal position of the pedal arm while no resistive load is applied to the operator when the pedal is located higher than the horizontal position of the pedal arm; and a hand-rail for supporting the operator to balance himself during the pedaling exercise wherein the weight of the operator is supported by the pedals.

* * * * *